United States Patent [19]

Gangell

[11] 4,019,582

[45] Apr. 26, 1977

[54] SPRINKLER SYSTEMS

[75] Inventor: David Bruce Gangell, Epping, Australia

[73] Assignee: Environ Mechanical Services Pty. Limited, Sydney, Australia

[22] Filed: Nov. 7, 1975

[21] Appl. No.: 629,871

[30] Foreign Application Priority Data

Dec. 6, 1975 Australia ..... 82079/75

[52] U.S. Cl. ..... 169/37

[51] Int. Cl.[2] ..... A62C 37/08

[58] Field of Search ..... 169/51, 37, 38, 39, 169/40; 126/317

[56] References Cited

UNITED STATES PATENTS

| | | | |
|---|---|---|---|
| 2,531,790 | 11/1950 | Rowley | 169/38 |
| 2,946,329 | 7/1960 | Metcalfe | 169/37 X |
| 3,130,790 | 4/1964 | Hodgman, Jr. | 169/40 |
| 3,389,884 | 6/1968 | Ault | 169/37 |
| 3,584,689 | 6/1971 | Willms | 169/38 X |

*Primary Examiner*—John J. Love
*Attorney, Agent, or Firm*—D. Paul Weaver

[57] ABSTRACT

This invention relates to installation of fire sprinkler systems. In particular the present invention provides a means of installing such system before or after a ceiling has been fixed in a building. Essentially the present invention provides a water dropper pipe, a sprinkler attached to the dropper pipe and an escutcheon means. In effect, the present invention allows the sprinkler system to be installed at the most convenient time during the building operation. The escutcheon means being positioned over the sprinkler only after positioning of the ceiling such that the escutcheon means abuts against the ceiling thereby covering the immediate area between the sprinkler and the ceiling.

20 Claims, 8 Drawing Figures

SPRINKLER SYSTEMS

This invention relates to sprinklers and more particularly to fire sprinkler systems for buildings.

Currently, sprinkler systems within buildings must be installed and tested after the ceiling and sometimes carpeting have been installed. Leakages in any part of the sprinkler system, therefore, often result in damage to the building's interior trimmings. The reason why the sprinkler system is installed after the commencement of the finishing trades is that there is no provision made to install the ceiling after the installation of the sprinkler head. Presently, the ceiling, or at least that part of the ceiling directly opposite the sprinkler outlet pipe, must be installed such that the sprinkler head and its associated cover plate may be correctly positioned.

Furthermore, the height of the sprinkler installation relative to the ceiling is critical because the cover plate should abut the ceiling to form an effective seal and also be aesthetically pleasing.

It is the purpose of the present invention therefore to provide a means for installing and testing a sprinkler system before the commencement of the finishing trades, thus avoiding costly damages. It is a further purpose of the invention to allow for easy removal of ceiling tiles before or after the installation of the sprinkler system. It is yet another purpose of the present invention to provide a means for mass producing sprinkler tubing parts thereby avoiding the need for individually measured and cut lengths of tubing.

Broadly then, the present invention provides a sprinkler assembly including a sprinkler unit, a dropper conduit for passing liquid therethrough, the sprinkler unit being connected to the outlet of said dropper conduit, a resilient escutcheon means positioned and maintained between said dropper conduit and said sprinkler unit, a ceiling means including an aperture therein to permit the passage of said sprinkler unit and said escutcheon means therethrough and a cover plate inserted into said aperture, said cover plate having a flange on the lower portion thereof and a cross sectional opening smaller than the cross sectional area of said escutcheon means whereupon inserting the upper end of said cover plate past said escutcheon means the escutcheon means is substantially deformed to abut the interior of said cover plate and hold said cover plate in position such that the said flange abuts against the said ceiling means to substantially cover the periphery of said aperture.

Also, the invention provides a method of installing a sprinkler including the following operations: positioning a resilient escutcheon means around the portion of the sprinkler which is to be connected to a sprinkler dropper conduit, said dropper conduit being capable to passing a liquid therethrough, connecting the sprinkler to said dropper conduit such that the escutcheon means is maintained therebetween, installing a ceiling means having an aperture therein to permit the passage of said sprinkler and the said escutcheon means therethrough, and inserting a cover plate into said aperture, said cover plate having a flange on the lower portion thereof and a cross sectional opening smaller than the cross sectional area of said escutcheon means whereupon inserting the upper end of said cover plate past said escutcheon means the escutcheon means is substantially deformed to abut the interior of said cover plate and hold said cover plate in position such that the said flange abuts against the said ceiling means to substantially cover the periphery of said aperture.

The invention will now be more fully described with reference to two particular embodiments thereof. In the drawings.

Figure 1:
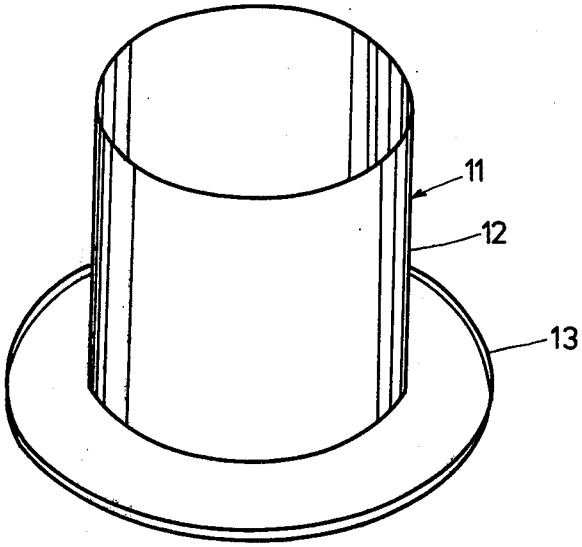
FIG. 1 is a perspective view of a cover plate.
Figure 2:
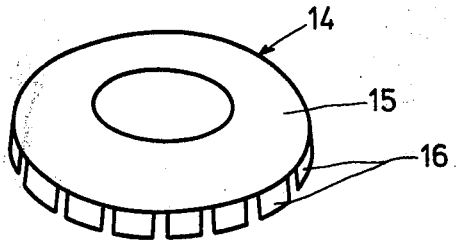
FIG. 2 is a perspective view of one form of insert.
Figure 3:
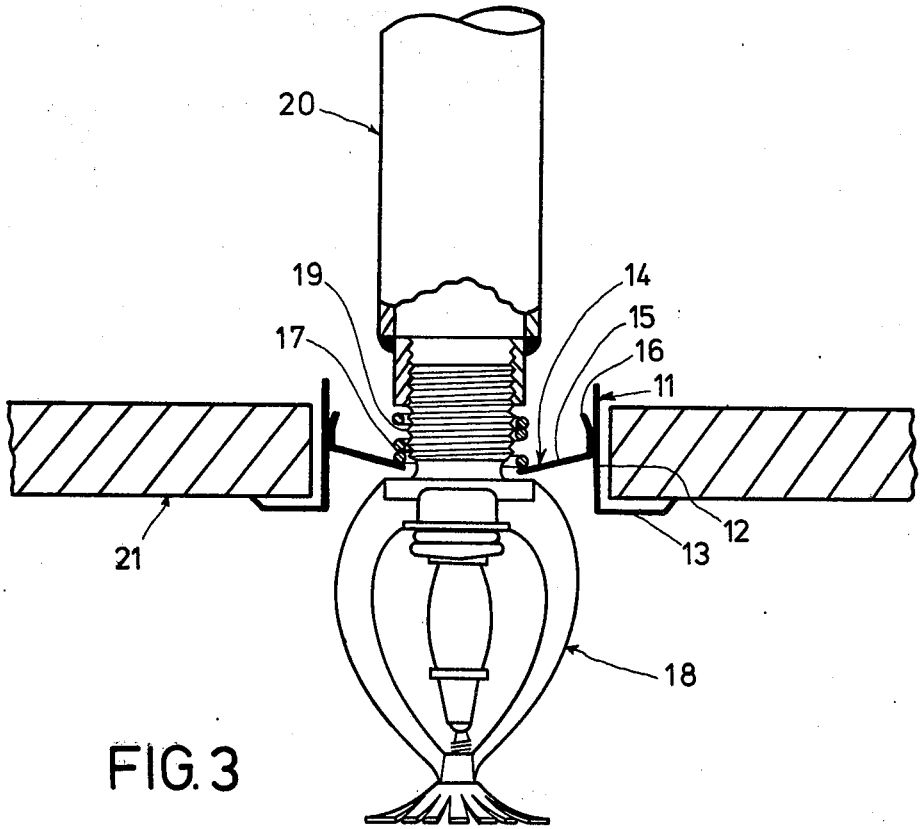
FIG. 3 is a partly cut-away view of one form of the present invention incorporating the cover plate of FIG. 1 and the insert of FIG. 2.

Referring now to FIGS. 1, 2 and most particularly FIG. 3, the first embodiment includes one form of cover plate 11, another form of insert 14 and preferably a spring 17. The cover plate 11 basically consists of a cylindrical portion 12 and a flange portion 13 extending from one end thereof. The diameter of the cylindrical portion 12 should be sufficiently large to allow the free passage of the entire sprinkler head 18. The insert 14 consists of an annular disc portion 15 with a plurality of outwardly extending tongues 16. The diameter of the hole in the annular disc 15 should be sufficiently large to allow the threaded portion 19 of the sprinkler head 18 to pass freely therethrough. The outermost diameter of the annular portion 15 of the insert 14 should preferably be just slightly larger than the inside diameter of the cylindrical portion 12 of the cover plate 11. As can best be seen from FIG. 3, the procedure for installing this particular embodiment of the present invention would be to initially position the insert 14 and spring 17 over the threaded portion 19 of the sprinkler 18. The sprinkler 18 would next be screwed securely into the dropper water pipe 20. Testing of the system for water leaks can therefore commence immediately after this stage of construction.

Since testing can be accomplished before the finishing trades enter the construction, there is no fear of damage caused by water leaking into tiles, walls, carpets, etc. After testing, and attending to any leaks which may have been detected, the ceiling tiles are placed into position on the ceiling grid where the sprinkler head 18 protrudes below the ceiling grid and a tile 21 with an appropriately positioned hole is merely placed over the head of the sprinkler 18. To finish off, the cover plate 11 is inserted over the head of the sprinkler 18 and pressed into position such that the flange 13 of cover plate 11 completely covers the hole in the tile 21. By the pressing action the tongues 16 of the insert 14 are bent towards the water pipe 20 and resiliently and frictionally hold the cover plate 11 in position against the tile 21. The spring 17, one end of which abuts against the insert 14, causes the inner portion of the insert 14 to depress against the upper part of the sprinkler head, thus giving a neat and complete closure.

Figure 4:
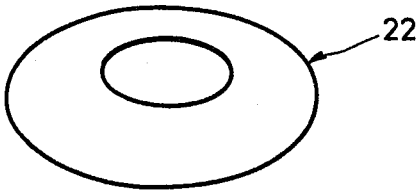
FIG. 4 is a perspective view of another form of insert.
Figure 5:
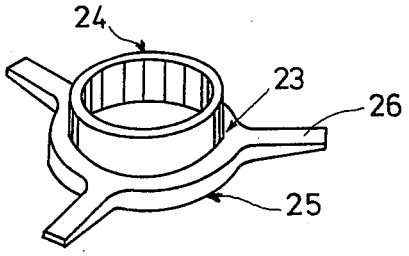
FIG. 5 is a perspective view of yet another insert which is used in conjunction with the insert of FIG. 4.

FIGS. 4 and 5 illustrate other possible forms of inserts, which may be used in conjunction with each other in place of the insert 14 and the spring 17 of the first embodiment. The insert 22 of FIG. 4 is basically of annular shape and is similar to the insert 14 with its associated tongues 16 removed. The insert 23, however, is somewhat more intricate in shape. This insert includes a cylindrical portion 24 at one end of which is a flange portion 25 to which are connected several outwardly extending tongues 26.

Figure 6:
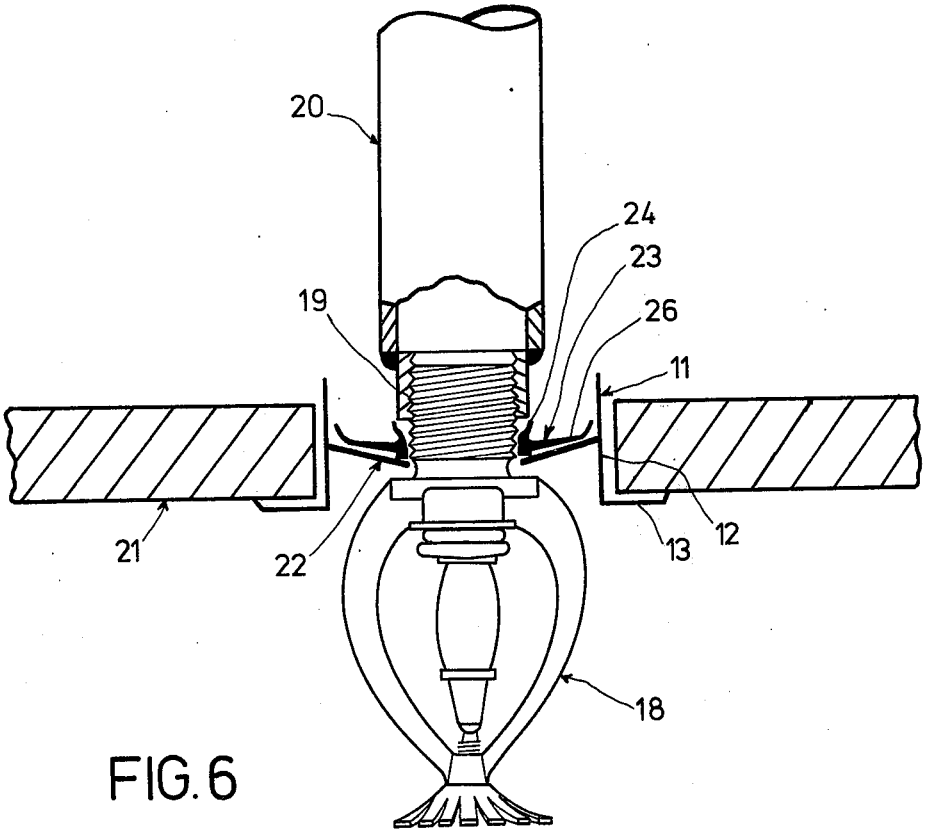
FIG. 6 is a partly cut-away view of a second form of the present invention incorporating the cover plate of FIG. 1 and the inserts of FIGS. 4 and 5.

FIG. 6 illustrates an assembled second embodiment of the present invention which utilizes the inserts of FIGS. 4 and 5. The procedure for assembly of this embodiment is similar to the first described embodiment in that the inserts 22 and 23 are firstly placed over the threaded portion 19 of the sprinkler 18. The sprinkler 18 is then screwed securely into the dropper water pipe 20. As with the first embodiment, the system can then be tested for efficiency and leakages prior to the commencement of the trimming and finishing trades. Finally, after checking for leaks, the ceiling tiles may then be placed into position on the ceiling grid. As previously indicated, the tile 21 with an appropriate hole adjacent the head of the sprinkler 18 is positioned over the sprinkler and the cover plate 11 is pressed into position to provide a complete and easy method of sealing. As can be seen from FIG. 6, also the cylindrical portion 24 of the insert 23, which is flexible and just slightly larger in diameter than the thread of the sprinkler, is caused to deform slightly on contacting the water pipe 20. This resilient deformation has a similar action on the insert 22 as the spring 17 of the first embodiment.

Figure 7:
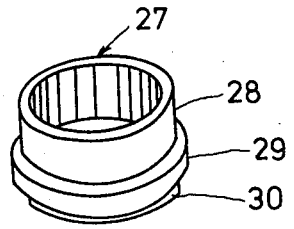
FIG. 7 is a perspective view of still yet another insert.

FIG. 7 illustrates yet another form of insert 27 which can be used in conjunction with the insert 14 of FIG. 2. The insert 27 comprises an upper cylindrical portion 28, a relatively thicker flange portion 29 and a tail portion 30 which is substantially of the same diameter as the upper cylindrical portion 28.

Figure 8:
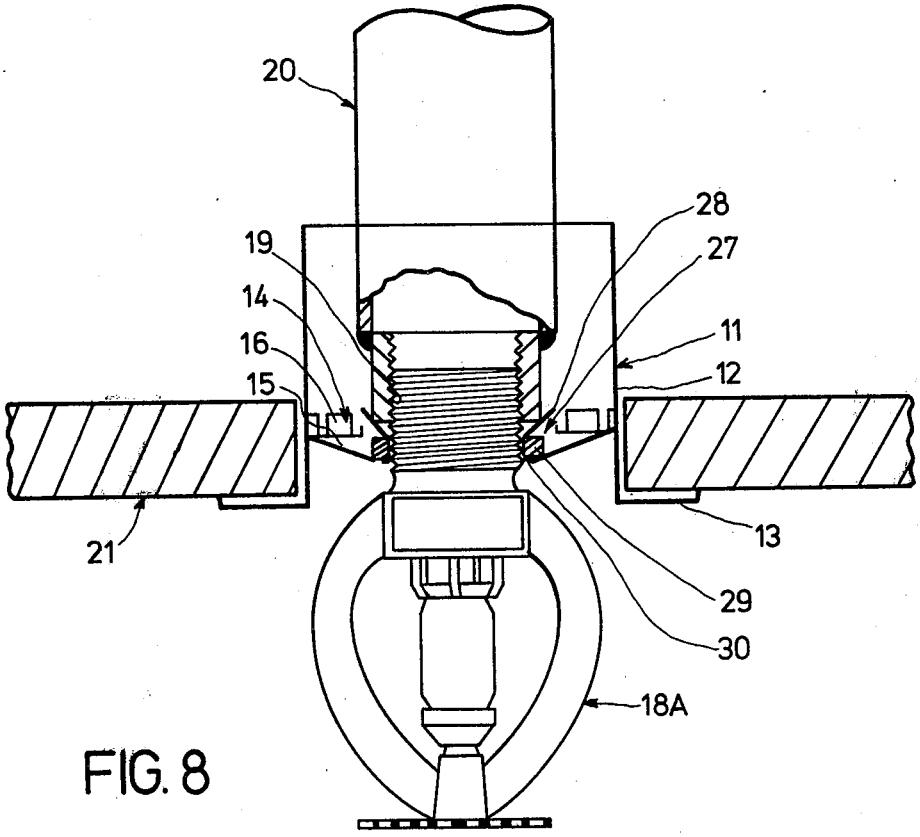
FIG. 8 is partly cut-away view of a third form of the present invention incorporating the cover plate of FIG. 1 and the insert of FIG. 7.

FIG. 8 with its cut-away section illustrates an assembled third embodiment of the invention comprising the inserts 14 and 27 together with the cover plate 11. The procedure for assembly of this embodiment is similar to the procedure of the previous two embodiments. That is, the inserts 14 and 27 are placed over the threaded portion 19 of the sprinkler and the sprinkler is then screwed into the dropper pipe 20. Again, as with the previous two embodiments, the entire sprinkler system can be tested at this early stage of construction. Any water leaks or malfunctions can then be rectified well in advance of the commencement of the construction finishing trades.

After the system has been tested and checked and found to be in order, the ceiling tiles may then be installed. Again, as with the previous two embodiments, the tile 21 with the appropriate hole adjacent the head of the sprinkler 18A is positioned over the sprinkler and the cover plate 11 is pressed into position to provide a complete seal between the ceiling tile and the sprinkler. As can best be seen from FIG. 8, when the cover plate 11 is inserted past the head of the sprinkler 18A and into the hole of tile 21, the tongues 16 of the insert 14 are bent upwardly towards the dropper pipe 20. Because of the resilient action of the tongues 16, the insert 14 effectively holds the cover plate 11 against the ceiling tile 21. The upper cylindrical portion 28 of the insert 27 abuts against the lowermost end of the dropper pipe 20 whilst the flange portion 29 of the insert 27 abuts against the inner periphery of the insert 14. These integers again provide a complete and aesthetically pleasing seal between the ceiling tile and the sprinkler.

It will become apparent to those skilled in the art that numerous modifications of the above arrangements are possible. For example, the cover plate 11 may be completely removed from each of the preferred embodiments and the resultant sealing effect would be just as effective. Other modifications will also become apparent and it is therefore intended that the above embodiments be interpreted merely as exemplary and not in a limiting sense.

What I claim is:

1. A sprinkler installation including a dropper conduit through which passes a liquid, a sprinkler attached to said dropper conduit, an escutcheon means positioned between said sprinkler and said dropper conduit, and a ceiling means, said ceiling means having an aperture to permit the passage of said sprinkler therethrough whereby said escutcheon means abuts said sprinkler and the periphery of said aperture, said dropper conduit being a pipe and said liquid being water, said escutcheon means comprising an annular insert, and another insert positioned between the dropper pipe and said insert to maintain the insert in position on said sprinkler, and said another insert comprising a cylindrical portion the uppermost part of which abuts said dropper pipe and a flange portion which abuts the first said insert.

2. The sprinkler assembly as claimed in claim 1 wherein a spacer member is positioned and maintained between the said dropper conduit and said escutcheon means.

3. The sprinkler assembly as claimed in claim 1 wherein the escutcheon means is a substantially thin annular insert.

4. The sprinkler assembly as claimed in claim 1 wherein the escutcheon means is a substantially thin annular insert with a plurality of tongues extending outwardly from the outer periphery thereof.

5. The sprinkler installation as claimed in claim 1 wherein said another insert includes a plurality of tongues which extend outwardly from the said flange portion of said second insert.

6. The sprinkler installation as claimed in claim 5 wherein the first said insert comprises a plurality of tongues which extend outwardly from the outermost periphery of first said insert.

7. A sprinkler assembly comprising a sprinkler, a dropper conduit for passing a liquid therethrough, said sprinkler being connected to the outlet end of said dropper conduit, a resilient escutcheon means positioned and maintained between said dropper conduit and said sprinkler, a ceiling means including an aperture therein to permit the passage of said sprinkler and said escutcheon means therethrough and a cover plate inserted into said aperture, said cover plate having a flange on the lower portion thereof and a cross sectional opening smaller than the cross sectional area of said escutcheon means whereupon inserting the upper end of said cover plate past said escutcheon means the escutcheon means is substantially deformed to abut the interior of said cover plate and hold said cover plate in position such that the said flange abuts against the said ceiling means to substantially cover the periphery of said aperture.

8. The sprinkler assembly as claimed in claim 7 wherein the said spacer member is a spring.

9. The sprinkler assembly as claimed in claim 7 wherein the spacer member is a collar member comprising a cylindrical portion the uppermost part of which abuts with the said dropper conduit and a flange portion on the lower part of the cylindrical portion, said flange portion abuts with said escutcheon means.

10. The sprinkler assembly as claimed in claim 7 wherein the spacer member is a collar having a cylindrical portion the uppermost part of which abuts with the dropper conduit, a flange portion on the lower part of the cylindrical portion and a plurality of tongues extending radially outwardly from the flange portion, said flange portion and tongues abutting the said escutcheon means.

11. A method of installing a sprinkler including the following operations: positioning an insert and another insert around the portion of the sprinkler which is to be attached to a sprinkler dropper pipe, attaching the sprinkler to said dropper pipe such that the said another insert abuts the dropper pipe at one end thereof and abuts the first said insert at the opposite end thereof, installing a ceiling means having an aperture therein to permit the passage of said sprinkler therethrough, and inserting a cover plate having a flange thereon into said aperture such that said flange abuts against the said ceiling means and substantially covers the periphery of said aperture such that the first said insert abuts the inside of the cylindrical portion of said cover plate.

12. The method of installing a sprinkler as claimed in claim 11 wherein the said another insert has an upper cylindrical portion which abuts with the said dropper pipe and the lower flange portion which abuts with first said insert.

13. The method of installing a sprinkler as claimed in claim 11 wherein the said another insert further includes a plurality of tongues which extend from said flange portion such that the said tongues abut the inside of the said cylindrical portion of said cover plate.

14. A method of installing a sprinkler including the following operations: positioning a resilient escutcheon means around the portion of the sprinkler which is to be connected to a sprinkler dropper conduit, said dropper conduit being capable of passing a liquid therethrough, connecting the sprinkler to said dropper conduit such that the escutcheon means is maintained therebetween, installing a ceiling means having an aperture therein to permit the passage of said sprinkler and the said escutcheon means therethrough, and inserting a cover plate into said aperture, said cover plate having a flange on the lower portion thereof and a cross sectional opening smaller than the cross sectional area of said escutcheon means whereupon inserting the upper end of said cover plate past said escutcheon means the escutcheon means is substantially deformed to abut the interior of said cover plate and hold said cover plate in position such that the said flange abuts against the said ceiling means to substantially cover the periphery of said aperture.

15. The method as claimed in claim 14 wherein a spacer member is positioned around the portion of the sprinkler which is to be connected to the sprinkler dropper conduit after positioning the said escutcheon means around the said sprinkler.

16. The method as claimed in claim 14 wherein the escutcheon means is a substantially thin annular insert.

17. The method as claimed in claim 14 wherein the escutcheon means is a substantially thin annular insert with a plurality of tongues extending outwardly from the outer periphery thereof.

18. The method as claimed in claim 15 wherein the said spacer member is a spring.

19. The method as claimed in claim 15 wherein the spacer member is a collar member comprising a cylindrical portion the uppermost part of which abuts with the said dropper conduit and a flange portion on the lower part of the cylindrical portion, said flange portion abuts with said escutcheon means.

20. The method as claimed in claim 14 wherein the said spacer member is a collar having a cylindrical portion the uppermost part of which abuts with the dropper conduit, a flange portion on the lower part of the cylindrical portion and a plurality of tongues extending radially outwardly from the flange portion, said flange portion and tongues abutting the said escutcheon means.

* * * * *